US006963054B2

(12) United States Patent
Couraud

(10) Patent No.: US 6,963,054 B2
(45) Date of Patent: Nov. 8, 2005

(54) DEVICE FOR HEATING AIR, FLUIDS AND MATERIALS, IN DRY OR WET ENVIRONMENT, POWERED WITH LOW VOLTAGE CURRENT OR ALTERNATING OR DIRECT VERY LOW SAFE ALLOWABLE VOLTAGE

(75) Inventor: Jean-Claude Couraud, Le Cannet (FR)

(73) Assignee: Jean-Claude Tourn, Monaco (MC)

( * ) Notice: Subject to any disclaimer, the term of this patent is extended or adjusted under 35 U.S.C. 154(b) by 0 days.

(21) Appl. No.: 10/149,977

(22) PCT Filed: Dec. 14, 2000

(86) PCT No.: PCT/FR00/03547

§ 371 (c)(1),
(2), (4) Date: Jun. 17, 2002

(87) PCT Pub. No.: WO01/45465

PCT Pub. Date: Jun. 21, 2001

(65) Prior Publication Data

US 2003/0000941 A1 Jan. 2, 2003

(30) Foreign Application Priority Data

Dec. 17, 1999 (FR) ..... 99 16108

(51) Int. Cl.[7] ..... H05B 3/16

(52) U.S. Cl. ..... 219/543; 219/541; 392/438; 392/439; 338/307; 338/308

(58) Field of Search ..... 219/543, 546, 219/549, 528, 203, 219, 520, 541, 505; 392/425, 434, 438, 439; 338/306, 307, 308, 309; 174/121 A

(56) References Cited

U.S. PATENT DOCUMENTS

| | | | | | |
|---|---|---|---|---|---|
| 3,798,419 | A | * | 3/1974 | Maake | 219/541 |
| 4,151,366 | A | * | 4/1979 | Betts et al. | 174/121 A |
| 4,237,366 | A | * | 12/1980 | Berg | 219/219 |
| 4,443,691 | A | * | 4/1984 | Sauer | 219/203 |
| 4,485,297 | A | * | 11/1984 | Grise et al. | 219/528 |
| 4,591,701 | A | * | 5/1986 | Tokumaru | 219/543 |
| 4,697,165 | A | * | 9/1987 | Ishiguro et al. | 338/306 |
| 4,931,627 | A | * | 6/1990 | Watts | 219/219 |
| 5,206,482 | A | * | 4/1993 | Smuckler | 219/219 |
| 5,285,049 | A | | 2/1994 | Fukumoto et al. | 219/216 |
| 6,392,209 | B1 | * | 5/2002 | Oppitz | 219/549 |

FOREIGN PATENT DOCUMENTS

| | | |
|---|---|---|
| EP | 0 641 845 | 3/1995 |
| FR | 2 709 590 | 3/1995 |

* cited by examiner

*Primary Examiner*—Fadi H. Dahbour
(74) *Attorney, Agent, or Firm*—James C. Lydon

(57) ABSTRACT

A device for heating air, fluids and materials, in dry or wet environments powered in low voltage current or alternating or direct very safe allowable voltage, by increasing the temperature of any type of surface, whether flat or embossed, solid or open-work. The device includes electrodes coated with a layer of electrically resistant fluid or pasty substance. The assembly of devices is very thin, and is particularly designed for heating premises, swimming pools, pipes exposed to freezing, and container for warm food.

12 Claims, 3 Drawing Sheets

DEVICE FOR HEATING AIR, FLUIDS AND MATERIALS, IN DRY OR WET ENVIRONMENT, POWERED WITH LOW VOLTAGE CURRENT OR ALTERNATING OR DIRECT VERY LOW SAFE ALLOWABLE VOLTAGE

This application is a U.S. National Stage of International application PCT/FR00/03547, filed Dec. 14, 2000, and published on Jun. 21, 2001 in the French Language.

The present invention concerns a method of electrical heating of air, fluids or materials, designed to cover all surfaces or objects either flat or otherwise, all sizes and shapes, filled-in or cellular, either functioning under very low power for safety purposes (TBTS) or at low power produced by a specially manufactured system.

We already know of the heat-resistant non-metallic material used in radiant electrical heaters invented by a Bulgarian under BG (patent) 15934, which consisted of:

Grey or black graphite, at the rate of 100 particles in weight

A neutral load material at the rate of 0 to 50 particles in weight

A black-fired varnish at the rate of 75 to 150 particles in weight

And coresiline at the rate of 60 to 120 particles in weight This material had the advantage of allowing local heating at low temperature using less energy than the traditional systems but having the disadvantage of using black or grey graphite and black-fired varnish as a binding agent. These heating agents containing grey or black graphite and black-fired varnish require mechanical treatment in order to provide the required electrical factors. Black-fired varnish provides a relatively low mechanical resistance, but it cracks quite rapidly, and once cracked becomes useless.

We also know about a heat-resistant electrical material for radiant heating, as stipulated in the French Patent demand FR A 2 593 185 deposited on 30$^{th}$ Oct. 1986, consisting of amorphous graphite, vinyl poly-acetate, adulterated alcohol and a diluting agent comprised of coresiline.

Whilst having the advantage of presenting very high heat-resistance, this material also has its disadvantages. For instance, the amount of resistance of this graphite paint is important, which only allows for a very feeble intensity of electrical current, for an applied voltage of about 50 volts at the terminals of such a coating.

Again we know about the demands for French patents FR 2 709 590 dated 3$^{rd}$ Sep. 1993, FR 2 709 589 dated 29$^{th}$ Apr. 1994 and the demand for a European patent EP 0 641 845 dated 26$^{th}$ Aug. 1994 deposited by the inventors THUNY and SINIGALIA.

Their invention also had certain disadvantages as was obvious from reading the description of the product and its uses, in that a banned substance (i.e. lead) was encased in it, and that also, the presence of PLIOWAY EC-1 rendered it too fluid. If the fluid worked very well on horizontal surfaces, the same could not be said for vertical application on walls for example (FIG. 2). The support which was uniquely lamellate was not really suitable for electrical junction with stretched conductors in the form of adhesives strips which caused multiple electrical arcing, α (2*a*) between the strips and the heated surface which was inevitably destroyed and became useless. On the other hand, connection to the electrical supply presented a real danger as it was carried out by means of overlapping electrical wires and/or the conductors; but especially the device was useless in humid conditions.

Elsewhere, it is possible to find paints which contain a low percentage in weight (generally about 3%) of conductive charge. The incorporation in the said paints of these charges is destined to improve their application and render them electrostatic. The said paints are not electrically conductive, in view of their low charge content.

The invention allows us to remedy these disadvantages. It ensures the possibility of connection to the electrical supply by means of two separate electrodes at a fixed or variable distance, the length L covered with a fluid or sticky material having adjustable electrical specific resistance, connected to points P and N.

Depending on the Particular Method of Production

The "phased" electrodes are connected to each other like teeth in a comb by a conductor or a conductive bar, to which the "neutral" electrodes are attached in the same manner between them either with one spatula head or with multiple connections, all the conductors/electrodes being fixed on an insulating base.

It comprises several phased and neutral electrodes in which the phased electrodes which are parallel to each other are connected to a central phased terminal, and to which the neutral electrodes also parallel to each other are connected to a central neutral terminal, the said phased and neutral electrodes being parallel and interspersed alternately.

It consists of two parts symmetrical to the base on which it will be applied, the electrodes on each part being arranged in such a manner that the neutral electrodes of one part are symmetrically interspersed with the phased electrodes of the other part.

The layer of sticky or fluid material covers the phased and neutral electrodes and the surface between them in such a manner that as soon as the current is switched on, the fluid or sticky material acts as a heating element.

The fluid or sticky material enclosed in a binding agent and/or a supple, elastic or flexible substance at the rate of 10 to 90% of its weight in conductive charge consisting of a mixture of two products, one a granular base, the other in strip form, having different electrical specific resistance, and the variable dose of 50/50 to 10/90% according to the expected final specific resistance.

The said products are, firstly, a granular mineral base consisting of particles having a nucleus of titanium dioxide or silica, covered with a solid solution consisting of a mixture of metal antimony and tin dioxide, and secondly, a mineral support in strip form having a mica base covered with a double oxide of tin and antimony.

A fluid layer covers all the electrodes and the heating surface and insulates and protects against oxidization.

A flame retardant electrical insulation, single or double leaf and/or fluid covers the whole.

A fluid electrical conductor or glued or adhesive leaf called the "earth" covers the whole of the process, and is connected to the earth of the electrical installation.

The entire device is sandwiched in a sheath which is entirely waterproof: Initially stuck to the base, then enclosed to form a sheath, either in a fluid or a glued or self-adhesive thermo-stiffened sheet to ensure total proof against humidity, and/or protection against shocks and/or acts as an electrical insulation.

The invention also applies to the process of manufacture as used in the production of such an electrical heating system for air, fluid or material, destined to cover surfaces or flat or cellular objects.

Phased and neutral electrodes are applied to a base which is already covered with an insulating film if it is not electrically insulating, the said electrodes being connected to phased or neutral terminals P and N;

An adjustable fluid or sticky material having electrical specific resistance is applied to the electrodes and between them;

The fluid or sticky material is left to dry;

A layer of electrical insulating material covers the whole.

With reference to these drawings, the method includes connection to the current by means of two electrodes (4 and 4') connected to terminals P and N length L, fixed on a base (1) and spaced having a distance d, forming a heating surface (S) a layer of fluid material (5) is spread on or between these cylindrical or long electrodes. This fluid or sticky material is enclosed in a binding agent for a surface coating/or a supple, elastic or flexible material of 10 to 90% in weight of resistant charge/electrical conductors consisting of a mix of two different types of base: one granular in order that the particles penetrate the spaces and corners as well as in between, on and under the strips of the other base which is called "lamellate". By choosing a different specific resistance between the two products, we can work on the temperature of the surface to be heated (S) by creating a mix having variable proportions of 50/50 to 10/90%.

Figure 1:
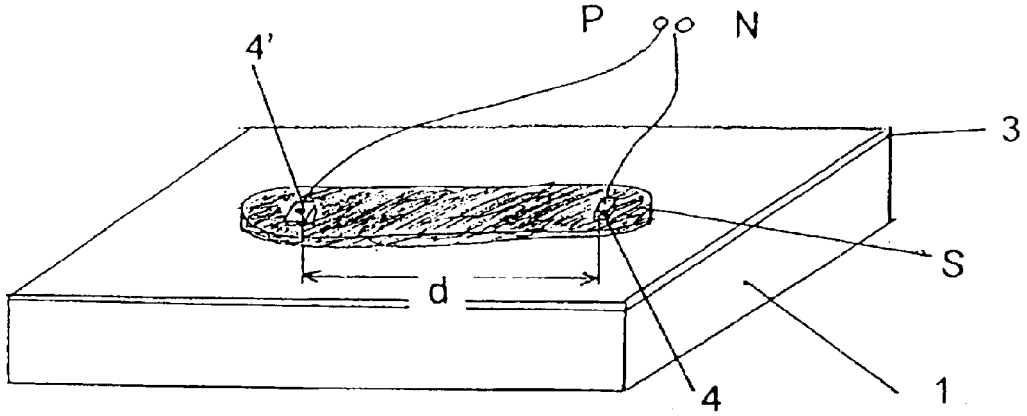
FIG. 1 shows the invention in accordance with the first method of manufacture.
Figure 2:
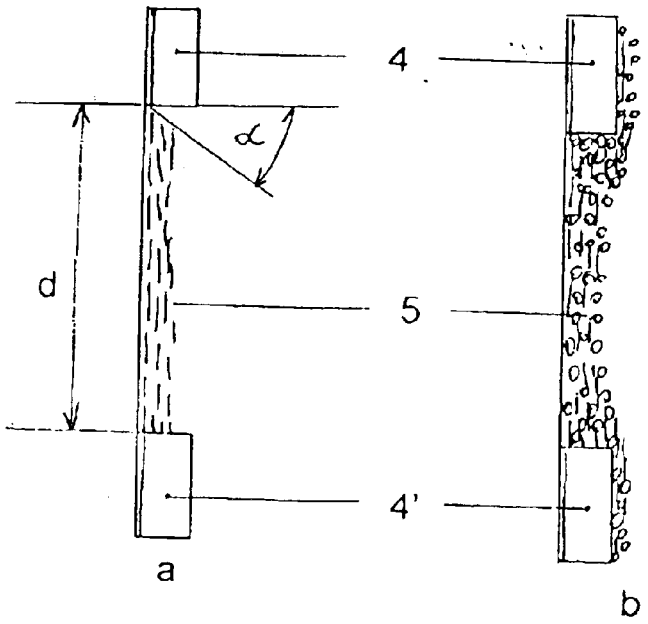
FIG. 2 shows a section of the molecular structure of the mixture.
Figure 3:
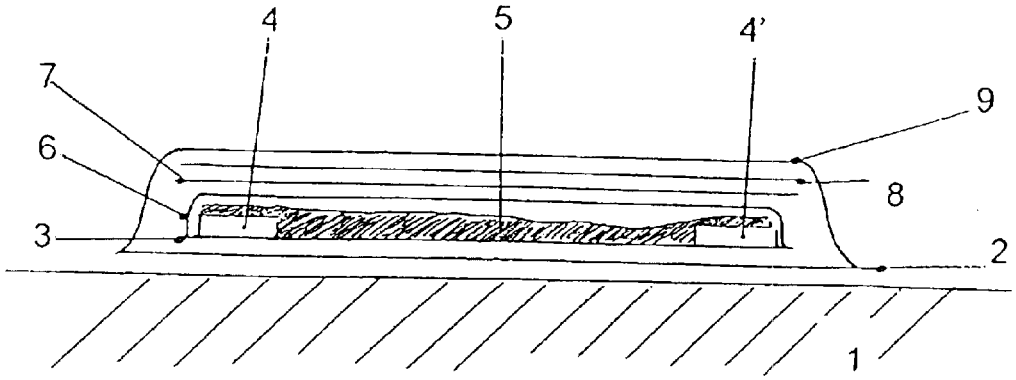
FIG. 3 shows a section of the different components of the device
Figure 4:
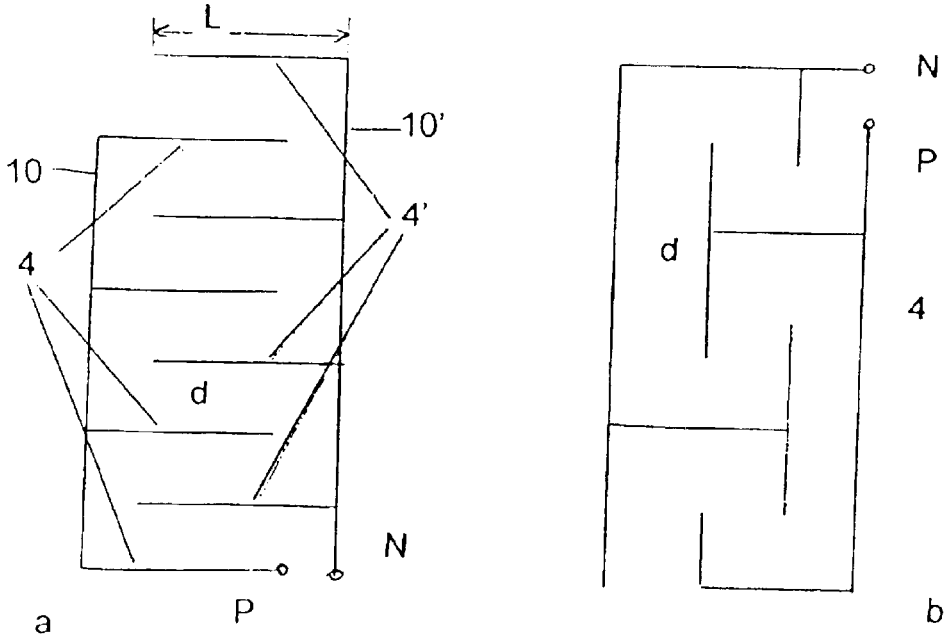
FIG. 4 shows two types of network of electrodes

In the type shown in FIG. 4*a*, the electrodes in strip form lying parallel are joined by a conductor (10 and 10') as in the teeth of a comb, then spread in spatula form in order to obtain an alternation of phased and neutral electrodes allowing for connection to be carried out in P and N without overlapping the connecting wires and those at one end and/or at both ends of the layout. In this way, we can produce a general heating surface in the form of a band by multiplying the number of electrodes having a regular temperature at all points.

In the form shown in FIG. 4*b*, the electrodes in strip form are connected to each other, either parallel or transversally. This type of multiple overlapping layout placed side by side allows for the heating of large areas.

The layer of fluid or sticky material is allowed to dry, then the whole is covered with a layer of fluid (6) to protect against oxidization. This fluid may also be electrically insulating.

On an electrical insulation (7) covered with the layer (6) an electrical conductor (8) formed by a layer of conducting fluid or a conductive leaf creating "the earth" covers the electrical insulation (7), and is connected to the earth of the electrical installation.

The whole layout is sandwiched between a waterproof layer (9) joined to the waterproof under-coat (2) forming a waterproof sheath. This last may be fluid, thermo-adhesive, thermo-hardening or stuck to materials such as tiles, plastic, glass . . .

In order to vary the power of the heating, we can act on four different parameters, i.e.

The specific resistance of the fluid or sticky material.

The length L of the electrodes

The spread d of the electrodes

The electrical current

The technical field of the invention is that of the components of the coating, for instance, the paint, varnish, thick coatings.

It may be used in many different fields such as:

In construction for the heating of premises and swimming pools.

In agriculture, in green-houses, for heating soil for cultivation.

In the automobile industry, nautical, clothing, textiles, food processing.

In any case, anybody connected with the trade, reading the above description would be aware of the limitless potential applications of this invention.

We intend to illustrate the invention in its principal form.

The electrically resistant fluid material called heating material was made with components which were incorporated as follows:

Binding agent: a varnish consisting of two separate parts which were then incorporated

| | |
|---|---|
| 1st part | |
| Plioway EC 1 | 6.45 |
| White spirit - 1% | 38.55 |
| Bentone SD 1 | 0.12 |
| Soya Lecithin | 0.05 |
| Subtotal | 45.17 |
| 2nd part | |
| Plioway EC-L | 7.67 |
| Dowanol DPnB | 0.95 |
| White Spirit - 1% | 46 |
| Bentone SD 1 | 0.15 |
| Soya Lecithin | 0.06 |
| Total | 100.00 |

Resistant charge

1410 T: sold as SPCI. These are granular particles of titanium dioxide, covered in a solid solution of a mixture of metal antimony and tin dioxide having a specific resistance of 3 ohm/cm.

Minatec 31: sold as MERCK. These are strip particles of mica covered in double oxide of tin and antimony having a specific resistance of 4 Kohm (MERCK method) less than 100 ohm/cm.

The product 1410 T is incorporated into the binding agent in the proportion of one volume for 5 volumes of binding agent. It is then allowed to stand for a period of 24 hours.

Then 4 volumes of the product Minatec 31 is slowly stirred into the substance the evening before use.

With one liter of heating material as described in the above method of manufacture, a surface area of $6m^2$ may be heated.

The following results were obtained using different criteria:

On material BA 13 (plasterboard covered with wallpaper)

| Voltage | D | Surface Temperature | Intensity |
|---|---|---|---|
| 220 volts | 12 cms | 62° C. | 2.01 A |
| 220 volts | 9 cms | more than 100° C. | 2.02 A |
| 45 volts | 2.8 cms | 65° C. | 0.1 A |
| 12 v continuous | 0.5 cm | 50.3° C. | 0.11 A for an area of 8 × 2 cm |
| 12 volt intermittent | 0.5 cm | 54° C. | 0.08 A for an area of 8 × 2 cm |
| On fabric | | | |
| 220 volts | 10 cms | 50.5° C. | 0.1 mA |

Figure 5:
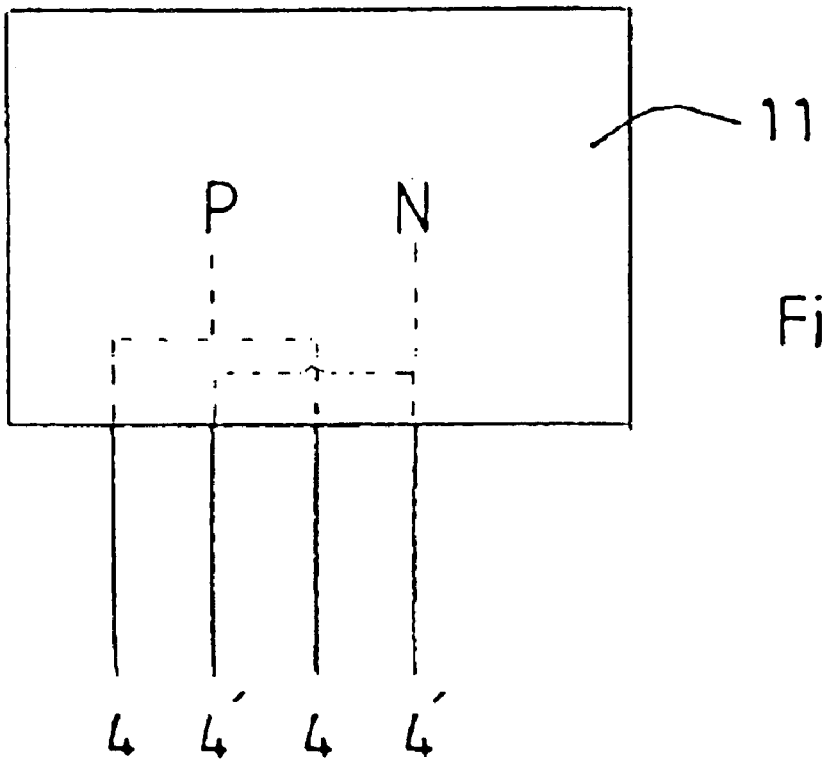
FIG. 5 shows a particular method of manufacture and supply of current to the constituent electrodes after connection.

Looking back at FIG. 5, you will note a diagram of an electrical junction box (11) containing a bi-polar inflow having a phased terminal (P) and a neutral terminal (N). Using this particular method, plurality of phased electrodes (4) and neutral (4') is provided in a special manner. As illustrated, the phased electrodes (4) are all communally connected to the phased terminal (P). In the same way, the neutral electrodes (4') are connected to the neutral terminal (N). What is more, all of the electrodes are in this case formed by parallel metallic bars and the neutral and phased electrodes laid-out alternately.

Figure 6:
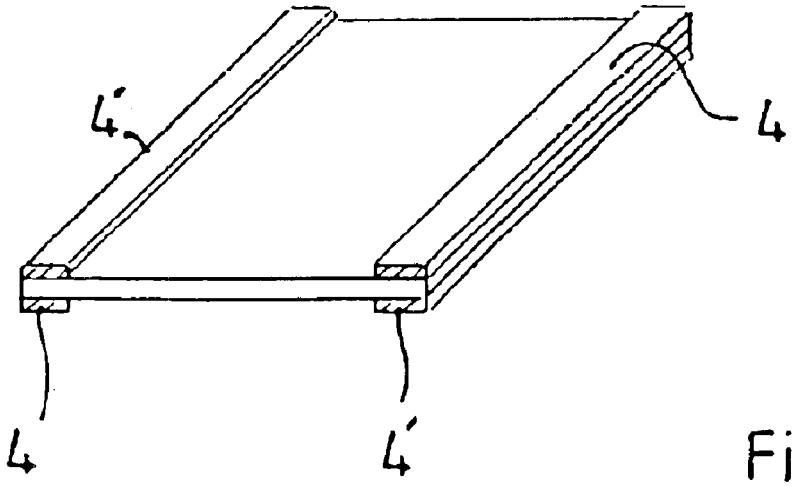
FIG. 6 illustrates in perspective a particular method of manufacture of an adaptation of the invention to cover two sides of a support.

In another variation of the invention as illustrated in FIG. 6, a double device is formed on each side of the base (1). FIG. 6 diagrammatically indicates the special position of the electrodes (4 and 4') without showing the other constitutive elements of the device.

Depending on the method of manufacture, two markedly identical devices are formed on each side of the base (1). In this instance, the electrodes (4 and 4') take the form of long metal bars connected on each of the two sides. To add to this, the phased electrode on one side is placed opposite the neutral electrode on the other side and vice-versa. The other stages of manufacture of the invention are the same as described previously and are the same on each side of the base (1).

The special positions adopted for the phased and neutral electrodes (4 and 4') have the advantage of enhancing security.

In fact, if inadvertently, the user pierces the base (1) (for example by means of a nail or screw) this method would immediately result in a power-cut caused by a short-circuit. The user having automatically come into contact with a phased electrode (4)

The invention also concerns a procedure for the manufacture of the layout as indicated above.

The following is a presentation of the essential phases of the manufacturing process. The object of the exercise is to provide a method of heating a base (1) for example in the form of a sheet or leaf or any other surface. In order to do this, we place a film of insulating material on the base (1) if this is an electrical conductor.

We then place phased electrodes (4) and neutral (4') on the base (1) prepared in this manner. In the best method, the electrodes (4 and 4') are metallic conductive elements in strip form.

Once the electrodes (4 and 4') are in position they are covered and so is the area between the electrodes (4 and 4') with a fluid or sticky material (5) as described above.

To protect the whole and electrically insulate their environment, they are covered by means of a layer of electrical insulating material (6).

This invention is of particular interest in the heating of areas having low voltage or very low voltage but is not limited to these areas.

| REFERENCES | |
|---|---|
| 1. | Base |
| 2. | Sheath |
| 3. | Insulating base |
| 4. | Phased electrode |
| 4'. | Neutral electrode |
| 5. | Fluid or sticky material |
| 6. | Layer |
| 7. | Electrical insulating material |
| 8. | Electrical conductor |
| 9. | Fluid |
| 10.10' | Conductor |
| 10. | Junction box |
| A. | Phase |
| N. | Neutral |

What is claimed is:

1. A device for heating air, fluid and materials, destined to cover surfaces and objects flat or otherwise, all sizes and shapes, filled-in or cellular, comprising a non-electrically conducting base surface having first and second electrodes separated from one another by a fixed or variable distance, length L, said first and second electrodes being adapted to be electrically connected to a source of electric current; and a material coated on at least a portion of said base surface over length L, said material having an adjustable specific resistance, such that when said first and second electrodes are connected to said source of electric current, said material acts as a heating element, wherein said material comprises a binding agent containing from 10 to 90% by weight in conductive charge of a mixture of a granular base and a base in strip form to provide electrical specific resistance, said granular base and base in strip form being present in a proportion of from 50/50 to 10/90% according to the required final specific resistance.

2. The device of claim 1, wherein said first and second electrodes each comprise a plurality of strips connected to a conductor, and wherein the strips of said first electrode are separated from each other by the strips of said second electrode.

3. The device of claim 2, wherein said strips of said first electrode are parallel to one another, and said strips of said second electrode are parallel to one another, and a strip of said first electrode is located between a strip of said second electrode.

4. The device of claim 1, wherein said first and second electrode each comprise two symmetrical parts mounted on opposite sides of a base, the first and second electrodes of each part arranged such that the first electrode on the first part are placed in symmetry with the second electrode on the second part.

5. The device of claim 1, wherein said material covers said first and second electrodes and said length L between said first and second electrodes.

6. The device of claim 1, wherein said granular base comprises particles in which the nucleus is titanium dioxide or silica, covered with a solid solution of a mixture of metal antimony and tin dioxide, and said base in strip form having a base of mica covered in a double oxide of tin and antimony.

7. The device of claim 1, further comprising a protective, electrically insulating layer which covers said first and second electrodes and said base surface.

8. The device of claim 1, further comprising a flame-proof electrically insulating layer which covers the device.

9. The device of claim 1, further comprising an electrical conductor which is adapted to be connected to a ground of said source of electric current.

10. The device of claim 1, wherein said device is enclosed within a waterproof covering.

11. A method of manufacturing a device designed to heat air, fluid and materials, destined to cover surfaces or objects either flat and/or shaped, comprising:

fixing first and second electrodes to a non-electrically conductive base surface, said electrodes being adapted to be electric ally connected to a source of electrical current;, said first and second electrodes being separated from one another by a fixed or variable distance, length L;

applying a fluid or sticky material having an adjustable specific resistance to said first and second electrodes and between said first and second electrodes;

permitting said fluid or sticky material to dry, wherein said material comprises a binding agent containing from 10 to 90% by weight in conductive charge of a mixture of a granular base and a base in strip form to provide electrical specific resistance, said granular base and base in strip form being present in a proportion of from 50/50 to 10/90% according to the required final specific resistance.

12. The method of claim 11, further comprising applying a layer of electrical insulating material to the whole device.

* * * * *